United States Patent [19]

Garner-Gray

[11] Patent Number: 4,539,131

[45] Date of Patent: Sep. 3, 1985

[54] SOLID DETERGENT COMPOSITION CONTAINING SODIUM PERBORATE MONOHYDRATE HAVING SPECIFIED SURFACE AREA

[75] Inventor: Peter F. Garner-Gray, Preston, England

[73] Assignee: Lever Brothers Company, New York, N.Y.

[21] Appl. No.: 501,586

[22] Filed: Jun. 6, 1983

[30] Foreign Application Priority Data

Jun. 25, 1982 [GB] United Kingdom ..... 8218537
Sep. 24, 1982 [GB] United Kingdom ..... 8227308

[51] Int. Cl.[3] ..... C11D 7/54; C11D 7/14; C11D 7/18; C11D 3/395

[52] U.S. Cl. ..... 252/99; 252/95; 252/140; 252/174.25; 252/186.3; 252/186.31; 252/186.43

[58] Field of Search ..... 252/95, 99, 140, 174.25, 252/186.3, 186.31, 186.43

[56] References Cited

U.S. PATENT DOCUMENTS 3,553,140 1/1971 Lindner et al. ..... 252/95
4,283,302 11/1981 Foret et al. ..... 252/95
4,333,844 6/1982 Duggleby et al. ..... 252/95

*Primary Examiner*—John Kittle
*Assistant Examiner*—Mukund J. Shah
*Attorney, Agent, or Firm*—Milton L. Honig; James J. Farrell

[57] ABSTRACT

Improved storage stability of detergent compositions containing an aluminosilicate material as a detergency builder and sodium perborate in the form of its monohydrate having a specific surface area of more than 5 $m^2/g$, preferably more than 7 $m^2/g$. Other conventional materials, in particular other detergency builders, and bleach activators may also be present in the compositions.

11 Claims, No Drawings

SOLID DETERGENT COMPOSITION CONTAINING SODIUM PERBORATE MONOHYDRATE HAVING SPECIFIED SURFACE AREA

This invention relates to detergent compositions which are particularly but not essentially, adapted for fabric washing, and more particularly to detergent compositions containing sodium perborate as a bleach component.

It is known to include sodium perborate in detergent compositions as a bleach component, the perborate being in the form commonly known as the tetrahydrate, which has the empirical formula:

$$NaBO_2.H_2O_2.3H_2O$$

While the stability of this material is adequate in compositions which contain, for example, sodium tripolyphosphate as a detergency builder, when this builder material is replaced wholly or in part with an alkalimetal aluminosilicate material or a mixture thereof with other builder materials, the stability of sodium perborate tetrahydrate is reduced, resulting in some cases in such poor stability that such compositions have substantially no effective bleach capacity after only a few months storage.

It is therefore an object of the present invention to provide a detergent composition containing a bleach component and an alkalimetal aluminosilicate material as a detergency builder, in which the stability of the bleach component is adequate.

Thus, according to the invention there is provided a solid detergent composition containing at least a detergent active material and an alkalimetal aluminosilicate material as a detergency builder, characterized in that the composition further contains sodium perborate monohydrate in particulate form having a specific surface area of at least 5 $m^2/g$, preferably more than about 7 $m^2/g$.

The sodium perborate monohydrate used in the present invention has the empirical formula:

$$NaBO_2.H_2O_2$$

While this is not strictly a monohydrate, but rather an anhydrate, this material is known commercially as the monohydrate and will be referred to throughout this specification as the monohydrate. It should not be confused with any other hydrates of sodium perborate, having different empirical formulae. However, the present invention may make use of mixtures of the monohydrate and tetrahydrate. While it is observed, as expected, that the stability of sodium perborate tetrahydrate in aluminosilicate-containing compositions decreases with increasing specific surface area, we have surprisingly discovered that, in the case of the monohydrate, the stability increases with increasing specific surface area and that above a threshold of 5 $m^2/g$, the monohydrate may be sufficiently stable to enable its use in detergent compositions, while the poor stability of the tetrahydrate in similar compositions may make its use less desirable.

The particle size of the perborate monohydrate is, when expressed in terms of aggregate size, to some extent independent of the specific surface area. Particle sizes of 100–1000 microns, most preferably 200–500 microns may be used in compositions according to the invention.

The detergent compositions of the invention necessarily contain a detergent active material. This may be a naturally derived detergent active material, such as soap, or a synthetic detergent active material selected from synthetic anionic, nonionic, amphoteric, zwitterionic or cationic detergent active materials or mixtures thereof.

Many suitable detergent active compounds are commercially available and are fully described in the literature, for example in "Surface Active Agents and Detergents", Volumes I and II, by Schwartz, Perry and Berch.

The total level of the detergent active material may be more than 6%, up to 40% by weight most preferably from about 10 to 25% by weight of the composition.

The synthetic anionic detergent compounds are usually water soluble alkali metal salts of organic sulphates and sulphonates having alkyl radicals containing from about 8 to about 22 carbon atoms, the term alkyl being used to include the alkyl portion of higher aryl radicals. Examples of suitable synthetic anionic detergent compounds are sodium and potassium alkyl sulphates, especially those obtained by sulphating higher ($C_8$–$C_{18}$) alcohols produced for example from tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; and olefin sulphonates, which term is used to describe the material made by reacting olefins, particularl $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Examples of suitable nonionic detergent compounds which may be used, preferably together with the anionic detergent compounds include in particular the reaction products of alkylene oxides, usually ethylene oxide, with alkyl ($C_6$–$C_{22}$) phenols, generally 5 to 25 EO, i.e. 5 to 25 units of ethylene oxides per molecule; the condensation products of aliphatic ($C_8$–$C_{18}$) primary or secondary linear or branched alcohols with ethylene oxide, generally 6 to 30 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of the anionic detergent compounds with, for example, nonionic compounds may be used in the detergent compositions, particularly to provide controlled low sudsing properties. This is beneficial for compositions intended for use in suds-intolerant automatic washing machines. The presence of some nonionic detergent compounds in the compositions may also help to improve the solubility characteristics of the detergent powder.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and nonionic detergent compounds.

As stated above, soaps may also be used in the compositions of the invention, preferably at a level of less than 30% by weight. They are particularly useful at low levels in binary (soap/anionic) or ternary mixtures together with nonionic or mixed synthetic anionic and nonionic detergent compounds, which have low sudsing properties. The soaps which are used are preferably the sodium, or less desirably potassium, salts of saturated or unsaturated $C_{10}$–$C_{24}$ fatty acids or mixtures thereof. The amount of such soaps can be varied between about 0.5% and about 25% by weight, with lower amounts of about 0.5% to about 5% being generally sufficient for lather control. Amounts of soap between about 2% and about 20%, especially between about 5% and about 15%, are preferably used to give a beneficial effect on detergency. This is particularly valuable in compositions used in hard water when the soap acts as a supplementary builder. In addition, we have found that the addition of soap helps to decrease the tendency of the compositions to form inorganic deposits in the wash, particularly where the composition contains a calcium ion precipitant material such as sodium carbonate or sodium orthophosphate, for which purpose it is preferred to use about 2% to about 15%, especially about 2.5% to about 10% by weight of soap in the composition. When soap is present, it is preferred that the total level of detergent actives, including the soap, lies between about 5% and about 40% by weight, most preferably between about 10% and about 25% by weight.

The detergent compositions of the invention also necessarily contain an alkali metal aluminosilicate material as a detergency builder.

The aluminosilicate builder material is preferably crystalline or amorphous material having the general formula:

$$(M_2O)_z.Al_2O_3.(SiO_2)_y x H_2O$$

wherein M is sodium and/or potassium, z is a number from 0.7 to 1.5, preferably about 1.0, y is a number from 0.8 to 6, preferably 1.3 to 4, and x is such that the moisture content is from 10% to 28% by weight. While theoretically, at least for a pure crystalline material, the value of z should be not more than 1.0 and the value of y should be not less than 1.0, in practice, particularly in amorphous materials, impurities may occur resulting in the possibility that the values of z and y may vary within the above ranges. The preferred range of aluminosilicate is from 5% to 60% most preferably 15–50% on an anhydrous basis. The aluminosilicate preferably has a particle size of from 0.1 to 100 microns, ideally between 0.1 and 10 microns and a calcium ion exchange capacity of at least 200 mg.calcium carbonate/g. In a preferred embodiment, the water-insoluble aluminosilicate ion exchange material has the formula.

$$NA_{12}(AlO_2SiO_2)_{12} x H_2O$$

wherein x is an integer of from 20 to 30, preferably about 27. This material is available commercially as Zeolite A.

The preferred level of the sodium perborate monohydrate (measured as $NaBO_2.H_2O_2$) is 2 to 50%, most preferably 2 to 40% such as 4 to 30%.

The weight ratio of the aluminosilicate material to the perborate monohydrate is preferrably between 30:1 and 1:10, most preferably between 30:1 and 1:8, such as between 12:1 and 1:2.

While the compositions of the invention may contain only the detergent active material(s), the aluminosilicate materials and the perborate monohydrate, other materials may also be present in the compositions. Thus, the compositions may contain further detergency builder materials selected from:

(a) other calcium ion-exchange builder materials,
(b) calcium sequesterant builder materials;
(c) precipitating builder materials; and
(d) mixtures thereof.

In particular, the compositions of the invention may contain a sequesterant builder material such as the sodium salt of nitrilotriacetic acid, or sodium tripolyphosphate. When a further builder material is present, it may be present at a level of less than 25% by weight.

The detergent compositions of the present invention may contain an activator for the perborate, particularly when the compositions are intended for washing fabrics at temperatures below about 60° C.

Activators for peroxybleach compounds have been amply described in the literature, including British Pat. Nos. 836,988, 855,735, 907,356, 907,358, 970,950, 1,003,310 and 1,246,339, U.S. Pat. Nos. 3,332,882 and 4,128,494, Canadian Pat. No. 844,481 and South African Pat. No. 68/6,344. Specific suitable activators include:

(a) N-diacylated and N,N′-polyacylated amines, such as N,N,N′,N′-tetraacetyl methylene diamine and N,N,N′,N′-tetraacetyl ethylene diamine, N,N-diacetylaniline, N,N-diacetyl-p-toluidine; 1,3-diacylated hydantoins such as, for example, 1,3-diacetyl-5,5-diamethyl hydantoin and 1,3-dipropionyl hydantoin; α-acetoxy-(NN,N′)-polyacylmalonamide, for example α-acetoxy-(N,N′)-diacetylmalonamide;
(b) N-alkyl-N-sulphonyl carbonamides, for example the compounds N-methyl-N-mesyl-acetamide, N-methyl-N-mesyl-benzamide, N-methyl-N-mesyl-p-nitrobenzamide, and N-methyl-N-mesyl-p-methoxybenzamide;
(c) N-acylated cyclic hydrazides, acylated triazones or urazoles, for example monoacetylmaleic acid hydrazide;
(d) O,N,N-trisubstituted hydroxylamines, such as O-benzoyl-N,N-succinyl hydroxylamine, O-acetyl-N,N-succinyl hydroxylamine, O-p-methoxybenzoyl-N,N-succinyl-hydroxylamine, O-p-nitrobenzoyl-N,N-succinyl-hydroxylamine and O,N,N-triacetyl hydroxylamine;
(e) N,N′-diacyl-sulphurylamides, for example N,N′-dimethyl-N,N′-diacetyl-sulphurylamide and N,N′-diethyl-N,N′-dipropionyl sulphurylamide;
(f) Triacylcyanurates, for example triacetyl cyanurate and tribenzoyl cyanurate;

(g) Carboxylic acid anhydrides, such as benzoic anhydride, m-chloro-benxoic anhydride, phthalic anydride, 4-chloro phthalic anhydride;

(h) Sugar esters, for example glycose pentaacetate;

(i) 1,3-diacyl-4,5-diacyloxy-imidazolidine, for example 1,3-diformyl-4,5-diacetoxy-imidazolidine, 1,3-diacetyl-4,5-diacetoxy-imidazolidine, 1,3-diacetyl-4,5-dipropionyloxy-imidazoline;

(j) Tetraacetylglycoluril and tetrapropionylglycoluril;

(k) Diacylated 2,5-diketopiperazine, such as 1,4-diacetyl-2,5-diketopiperazine, 1,4-dipropionyl-2,5-diketopiperazine and 1,4-dipropionyl-3,6-dimetyl-2,5-diketopiperazine;

(l) Acylation products of propylenediurea or 2,2-dimethylpropylenediurea (2,4,6,8-tetraaza-bicyclo-(3,3,2)-nonane-3,7-dione or its 9,9-dimethyl derivative), especially the tetraacetyl- or the tetrapropionylpropylenediurea or their dimethyl derivatives;

(m) Carbonic acid esters, for example the sodium salts of p-(ethoxycarbonyloxy)-bensoic acid and p-(propoxycarbonyloxy)-benzenesulphonic acid;

(n) Acyloxy-(N,N$^1$)polyacyl malonamides, such as α-acetoxy(N,N$^1$)diacetyl malonamide.

The N-diacylated and N,N'-polyacylatedamines mentioned under (a) are of special interest, particularly N,N,N',N'tetra-acetyl-ethylenediamine (TAED).

The ratio by weight of the perborate to the activator may be about 20:1 to about 1:1, preferably about 10:1 to about 2:1, although weight ratios outside these limits are not excluded. Whilst the amount of the bleach system, i.e. perborate and activator may be varied between about 5% and about 35% by weight of the detergent compositions, it is especially preferred to use about 6% to about 30% of the ingredients forming the bleach system. Thus, when an activator is present, the preferred level of the perborate monohydrate in the composition is between 2% and 30% by weight, most preferably between about 5.0% and about 27% by weight, while the preferred level of the activator is between about 0.5% and about 10%, most preferably between about 1.0% and about 8.0% by weight.

In the case of TAED it is preferred to use the activator in granular form, preferably wherein the activator is finely divided as described in GB No. 2 053 998. Specifically, it is preferred to have an activator of an average particle size of less than 150 micrometers, which gives significant improvement in bleach efficiency. The sedimentation losses, when using an activator with an average particle size of less than 150 μm, are substantially decreased. Even better bleach performance is obtained if the average particle size of the activator is less than 100 μm. On the other hand, the activator may have a certain amount of particles of a size greater than 150 μm, but it should not contain more than 5% by weight of particles greater than 300 μm, and not more than 20% by weight of particles greater than 200 μm, preferably greater than 150 μm. It is to be understood that these particle sizes refer to the activator present in the granules, and not to the granules themselves. In a suitable such granule, the major part of the granules range from 100 to 2000 μm, preferably 250 to 1000 μm. Up to 5% by weight of granules with a particle size of greater than 1700 μm and up to 10% by weight of granules less than 250 μm is tolerable. The granules incorporating the activator, preferably in this finely-divided form, may be obtained by granulating a suitable inorganic or organic carrier material with activator particles of the required size. The granules can be subsequently dried, if required. Basically, any granulation process is applicable, as long as the granule contains the activator, and as long as the other materials present in the granule do not negatively affect the activator.

It is particularly preferred to include in the detergent compositions a stabiliser for the bleach system for example ethylene diamine tetramethylene phosphonate and diethylene triamine pentamethylene phosphonate. These activators can be used in acid or salts form, especially in calcium, magnesium, zinc or aluminium salt form, as described in GB No. 2 048 930. The stabiliser may be present at a level of up to about 1% by weight, preferably between about 0.1% and about 0.5% by weight.

Apart from the components already mentioned, the detergent compositions of the invention can contain any of the conventional additives in the amounts in which such materials are normally employed in fabric washing detergent compositions. Examples of these additives include other bleach materials such as peroxyacids and photobleaches, lather boosters such as alkanolamides, particularly the monoethanolamides derived from palm kernel fatty acids and coconut fatty acids, lather depressants such as alkyl phosphates and silicates, anti-redeposition agents such as sodium carboxymethylcellulose and alkyl or substituted alkyl cellulose, ethers other stabilisers such as ethylenediamine tetraacetic acid, fabric softening agents, inorganic salts such as sodium sulphate, and, usually present in very minor amounts, fluorescent agents, perfumes, enzymes such as proteases and amylases, germicides and colourants. In particular, compositions according to the invention may include the salt of an alkyl phosphoric acid as suds-suppressant and a wax as hydrophobic material as disclosed in DOS 2 701 664.

It is desirable to include one or more antideposition agents in the detergent compositions of the invention, to decrease a tendency to form inorganic deposits on washed fabrics. The amount of any such antideposition agent is normally from about 0.1% to about 5% by weight, preferably from about 0.2% to about 2.5% by weight of the composition. The preferred antideposition agents are anionic polyelectrolytes, especially polymeric aliphatic carboxylates, or organic phosphonates.

It may be desirable to include in the compositions an amount of an alkali metal silicate, particularly sodium ortho-, meta- or preferably neutral or alkaline silicate. The presence of such alkali metal silicates at levels of at least about 1%, and preferably from about 5% to about 15% by weight of the compositions, is advantageous in decreasing the corrosion of metal parts in washing machines, besides giving processing benefits and generally improved powder properties. The more highly alkaline ortho- and meta-silicates would normally only be used at lower amounts within this range, in admixture with the neutral or alkaline silicates.

The compositions of the invention are required to be alkaline, but not too strongly alkaline as this could result in fabric damage and also be hazardous for domestic usage. In practice the compositions should give a pH of from about 8.5 to about 11 in use in aqueous wash solution. It is preferred in particular for domestic products to have a pH of from about 9.0 to about 10.5 as lower pHs tend to be less effective for optimum detergency building, and more highly alkaline products can be hazardous if misused. The pH is measured at the lowest normal usage concentration of 0.1% w/v of the product in water of 12° H (ca), (French permanent hardness, calcium only) at 50° C. so that a satisfactory degree of alkalinity can be assured in use at all normal product concentrations.

The detergent compositions of the invention should be in free-flowing particulate, e.g. powdered or granular form, and can be produced by any of the techniques commonly employed in the manufacture of such washing compositions, but preferably by slurry making and spray drying processes to form a detergent base powder to which the perborate monohydrate is added. It is preferred that the process used to form the compositions should result in a product having a moisture content of from about 4% to about 10% by weight.

The invention will now be illustrated by the following non-limiting examples:

EXAMPLE 1

Commercially available sources of sodium perborate monohydrate having different specific surface areas were incorporated in base compositions to give an overall average available oxygen of 2.56%. The compositions comprised approximately:

| | |
|---|---|
| Anionic detergent active[1] | 12.0% |
| Nonionic detergnt active[2] | 5.5% |
| Soap[3] | 9.2% |
| Zeolite A (calculated as anhydrous) | 33.0% |
| Sodium silicate[4] | 14.7% |
| Sodium perborate monohydrate (calculated as $NaBO_2.H_2O_2$) | 16.0% |
| Water and minor ingredients | balance to 100% |

Notes:
[1]The anionic detergent active was an alkyl benzene sulphonate with an average alkyl chain length of 11–13 and an average moledular weight of 345.
[2]The nonionic detergent active was Dobanol-45 11 EO (an ethoxylated alkanol available from Shell)
[3]The soap was the sodium soap of 50/50 hardened rape seed hardened tallow fatty acids
[4]The sodium silicate had a $Na_2O:SiO_2$ molar ratio of 1:1.6

Each composition was stored at 37° C. in a sealed glass bottle. When the composition had been stored for various periods between 2 and 12 weeks, the percentage available oxygen was assessed and used to calculate the rate constant for the decomposition of the perborate monohydrate as an indication of its stability. In the following Table I, the rate constant is shown against the specific surface area as measured by gas adsorption. For comparison purposes the rate constants obtained with similar compositions containing perborate tetrahydrate (at the same available oxygen level) are also shown.

TABLE I

| Perborate Type | Specific Surface Area $m^2/g$ | Rate Constant Weeks$^{-1}$ |
|---|---|---|
| Monohydrate | 4.85 | $34.1 \times 10^{-3}$ |
| | 5.89 | $20.4 \times 10^{-3}$ |
| | 7.85 | $14.4 \times 10^{-3}$ |
| Tetrahydrate | 0.14 | $21.6 \times 10^{-3}$ |
| | 0.18 | $26.7 \times 10^{-3}$ |
| | 0.36 | $34.9 \times 10^{-3}$ |

These results illustrate that, even under conditions which are favourable to the storage stability of perborate tetrahydrate, the stability of perborate monohydrate is better (i.e. has a lower rate constant) than the tetrahydrate when its specific surface area is above 5 $m^2/g$ and that this stability increases with increasing surface area of the monohydrate.

EXAMPLE 2

Commercially available perborate monohydrate and perborate tetrahydrate (included for comparison purposes) were incorporated into a base powder at a level equivalent to 1.76% average available oxygen. The compositions were stored in sealed glass bottles or laminated packs under identical conditions (37° C. and 70% relative humidity). After storage for various periods between 2 and 12 weeks the level of available oxygen was determined and the decomposition rate constant derived therefrom. The formulations and results are set out in the following Table II.

TABLE II

| Example No: | 2A | 2B |
|---|---|---|
| Ingredients: | | |
| Anionic detergent active[5] | 4.3 | 4.0 |
| Nonionic detergent active[6] | 6.5 | 6.0 |
| Zeolite A (calculated as anhydrous) | 21.5 | 20.0 |
| NTA[7] (calculated as anhydrous) | 16.1 | 15.0 |
| Sodium silicate[8] | 6.5 | 6.0 |
| Sodium sulphate | 23.3 | 21.7 |
| Sodium perborate monohydrate (7.85 $m^2/g$) (calculated as $NaBO_2.H_2O_2$) | 11.0 | — |
| Sodium perborate tetrahydrate (0.36 $m^2/g$) (calculated as $NaBO_2.H_2O_2.3H_2O$) | — | 17.0 |
| Water and minor ingredients | balance to 100% | |
| Results: | | |
| Rate constant (weeks$^{-1}$) | | |
| Bottles | about $8 \times 10^{-3}$ | about $600 \times 10^{-3}$ |
| Packs | $73 \times 10^{-3}$ | $700 \times 10^{-3}$ |

Notes:
[5]The anionic detergent active was as in Example 1
[6]The nonionic detergent active was as in Example 1
[7]Sodium salt of nitrilotriacetic acid
[8]The sodium silicate had a $Na_2O:SiO_2$ molar ratio of 1:1.6

EXAMPLE 3

Detergent compositions were prepared according to the formulations set out in the following Table IIIA.

TABLE IIIA

| Example No: | 3A | 3B[9] |
|---|---|---|
| Ingredients: | | |
| Anionic detergent active[10] | 6.0 | 6.0 |
| Nonionic detergent active[11] | 4.0 | 4.0 |
| Sodium tripolyphosphate[12] | 18.0 | 18.0 |
| Zeolite A (calculated as anhydrous) | 21.0 | 21.0 |
| Sodium perborate monohydrate[13] (calculated as $NaBO_2.H_2O_2$) | 9.8 | — |
| Sodium perborate tetrahydrate[14] (calculated as $NaBO_2.H_2O_2.3H_2O$) | — | 15.0 |
| Sodium sulphate | 20.4 | 15.2 |
| Water and minor ingredients | balance to 100% | |

Notes:
[9]Included for comparison purposes
[10]The anionic detergent active was as in Example 1
[11]The nonionic detergent active was as in Example 1
[12]Containing minor proportions of sodium ortho phosphate and sodium pyrophosphate
[13]Specific surface area 7.85 $m^2/g$
[14]Specific surface area 0.36 $m^2/g$ These compositions were stored under two sets of conditions namely 28° C. at 70% relative humidity (RH) and 37° C. at 70% RH. At 5, 8 and 12 weeks the percentages of perborate which had decomposed was assessed. The results are given in the following Table IIIB:

TABLE IIIB

| Storage Conditions: | Example No: 3A | 3B |
|---|---|---|
| 28° C./70% RH | | |
| 5 weeks | 8 | 12 |
| 8 weeks | 16 | 22 |
| 12 weeks | 19 | 27 |
| 37° C./70% RH | | |
| 5 weeks | 18 | more than 90 |
| 8 weeks | 42 | more than 90 |
| 12 weeks | 66 | more than 90 |

EXAMPLE 4

A composition was prepared having the following formulation:

| Ingredient: | % by weight |
|---|---|
| Anionic detergent active[15] | 6.5 |
| Soap[16] | 5.0 |
| Nonionic detergent active[17] | 3.0 |
| Zeolite A (calculated as anhydrous) | 30.0 |
| NTA[18] | 10.0 |
| Sodium perborate monohydrate[19] (calculated as $NaBO_2.H_2O_2$) | 14.0 |
| Sodium alkaline silicate | 3.0 |
| Sodium sulphate | 14.5 |
| Sodium carboxymethylcellulose (SCMC) | 0.4 |
| Sodium succinate | 5.0 |
| Water | balance to 100 |

Notes:
[15]The anionic detergent active was as in Example 1
[16]The Soap was as in Example 1
[17]The nonionic detergent active was as in Example 1
[18]As in Example 2
[19]Specific surface area 6.8 $m^2/g$ - particle size 300–400 microns.

The composition was prepared by spray drying a slurry of the anionic material, soap, silicate, sulphate and zeolite, post-dosing the remaining ingredients with the exception of the nonionic active and the succinate and subsequently granulating using a mixture of the nonionic active and the succinate as a binder.

The composition was stored in wax-laminated packs for 12 weeks at 37° C. and 70% RH. After that time it was found that 7% of the perborate monohydrate had decomposed and that the composition was still in the form of a free flowing, non-lumpy crisp powder.

In a parallel experiment the perborate monohydrate was replaced with 25% perborate tetrahydrate (the level of sodium sulphate being reduced to compensate). After the same storage test 77% of the perborate tetrahydrate was found to have decomposed and the composition was in the form of a creepy, partly-lumpy soft powder.

EXAMPLE 5

The following formulation illustrates the use of perborate monohydrate in an amorphous aluminosilicate-containing composition:

| Ingredient | % by weight |
|---|---|
| Anionic detergent active[20] | 6.5 |
| Nonionic detergent active[20] | 3.0 |
| Soap[20] | 5.0 |
| Amorphous aluminosilicate[21] | 30.0 |
| Sodium nitrilotriacetate | 10.0 |
| Sodium perborate monohydrate (7.85 $m^2/g$) | 9.8 |
| Sodium silicate | 5.0 |
| Sodium sulphate | 19.7 |
| Minor ingredients (including sodium carboxy- | 2.0 |

-continued

| Ingredient | % by weight |
|---|---|
| methyl cellulose, EDTA, fluorescer and lather controller) | |
| Water | Balance to 100 |

Notes
[20]as in Example 1
[21]Having an empirical formula $Na_2O.Al_2O_3.(SiO_2)_2.H_2O$ prepared according to British Pat. No. 1 473 202 calculated as the anhydrous material) with an average particle size about 5 μ.

On storage the stability of the perborate in this composition is superior to that in which the monohydrate is replaced by the tetrahydrate (the level of sodium sulphate being reduced to compensate).

EXAMPLE 6

Detergent compositions were prepared according to the formulations set out in the following Table VI A:

TABLE VIA

| Example No | 6A | 6B[22] | 6C | 6D[22] |
|---|---|---|---|---|
| Ingredients: | | | | |
| Anionic detergent active[23] | 4.0 | 4.0 | 4.0 | 4.0 |
| Nonionic detergent active[23] | 6.0 | 6.0 | 6.0 | 6.0 |
| NTA[24] | 12.5 | 12.5 | 15.0 | 15.0 |
| Zeolite A (calculated as anhydrous) | 25.0 | 25.0 | 20.0 | 20.0 |
| Sodium perborate monohydrate[25] (calculated as $NaBO_2.H_2O_2$) | 9.8 | — | 9.8 | |
| Sodium perborate tetrahydrate[26] (calculated as $NaBO_2.H_2O_2.3H_2O$) | — | 15.0 | — | |
| Fine TAED | 2.0 | 2.0 | 2.0 | 2.0 |
| Sodium sulphate, water and minor ingredients | | balance to 100% | | |

Notes:
[22]Included for comparison purposes
[23]As in Example 1
[24]As in Example 2
[25]Specific surface area 7.85 $m^2/g$
[26]Specific surface area 0.36 $m^2/g$ These compositions were stored under two sets of conditions, namely 28° C. at 70% relative humidity (RH) and 37° C. at 70% RH. At 4, 8 and 12 weeks the percentage of perborate which had decomposed was assessed. The results are given in the following Table VI B:

TABLE VIB

| Storage Conditions | Example No 6A | 6B | 6C | 6D |
|---|---|---|---|---|
| | % perborate decomposed | | | |
| 28° C./70% RH | | | | |
| 4 weeks | 6 | 28 | 8 | 32 |
| 8 weeks | 32 | 54 | 27 | 44 |
| 12 weeks | 42 | 51 | 54 | 53 |
| 37° C./70% RH | | | | |
| 4 weeks | 23 | 100 | 25 | 98 |
| 8 weeks | 59 | 100 | 62 | 100 |
| 12 weeks | 59 | 100 | 80 | 100 |

EXAMPLE 7

Beneficial results can be obtained with compositions according to the following formulations:

| Example No Ingredients (%) | 7A | 7B | 7C | 7E |
|---|---|---|---|---|
| Anionic active[27] | — | 10.0 | — | — |
| Nonionic active[28] | 12.0 | — | 7.0 | 8.0 |

-continued

| Example No<br>Ingredients (%) | 7A | 7B | 7C | 7E |
|---|---|---|---|---|
| Soap[29] | — | — | 7.0 | 15.0 |
| Zeolite A[30] | 30.0 | 30.0 | 30.0 | 30.0 |
| Sodium carbonate[30] | 10.0 | — | — | — |
| Sodium orthophosphate[30] | — | 10.0 | — | — |
| NTA[32] | — | — | 10.0 | 10.0 |
| Alkaline sodium silicate | 6.0 | 6.0 | 6.0 | 6.0 |
| Sodium perborate monohydrate[31] | 13.0 | 13.0 | 11.0 | 10.0 |
| TAED | — | — | 2.0 | 3.0 |
| Dequest 2041 | — | — | 0.3 | 0.3 |
| Sodium sulphate | 18.0 | 16.0 | 14.5 | 5.5 |
| Water and minor ingredients | | | balance | |

Notes
[27]As in Example 1
[28]As in Example 1
[29]53% tallow soap, 27% coconut soap and 20% hardened rape seed soap
[30]Calculated as anhydrous
[31]Specific surface area 7.85 $m^2/g$. Calculated as $NaBO_2.H_2O_2$
[32]As in Example 2

I claim:

1. A solid detergent composition comprising:
(a) from 6 to 40% of a detergent active material;
(b) from 5 to 60% of an alkalimetal aluminosilicate material as a detergency builder;
(c) from 2 to 50% of sodium perborate monohydrate having the empirical formula:

$$NaBO_2 \cdot H_2O_2$$

in particulate form having a specific surface area of at least 5.89 $m^2/g$.

2. A composition according to claim 1, wherein the alkalimetal aluminosilicate material is a crystalline material.

3. A composition according to claim 1, containing from 15 to 50% by weight of the aluminosilicate builder.

4. A composition according to claim 1, containing an activator for said sodium perborate, the ratio by weight of the perborate to the activator being about 20:1 to about 1:1.

5. A composition according to claim 1, wherein the activator comprises tetraacetylethylene diamine.

6. A composition according to claim 1, wherein the tetraacetylethylene diamine is in granular form.

7. A composition according to claim 1, wherein the weight ratio of the aluminosilicate material to the perborate monohydrate is between 30:1 and 1:10, preferably 12:1 and 1:2.

8. A composition according to claim 1, further containing a further detergency builder material selected from:
(a) other calcium ion exchange builder materials;
(b) calcium sequestrant builder materials;
(c) precipitating builder materials; and
(d) mixtures thereof.

9. A composition according to claim 5, containing less than 25% by weight of the further detergency builder material.

10. A composition according to claim 1, wherein the detergent active material comprises less than 30% by weight soap.

11. A composition according to claim 1, wherein the detergent active material comprises a synthetic detergent active material.

* * * * *

REEXAMINATION CERTIFICATE (1347th)

United States Patent [19]

[11] B1 4,539,131

Garner-Gray

[45] Certificate Issued Sep. 4, 1990

[54] SOLID DETERGENT COMPOSITION CONTAINING SODIUM PERBORATE MONOHYDRATE HAVING SPECIFIED SURFACE AREA

[75] Inventor: Peter F. Garner-Gray, Preston, England

[73] Assignee: Lever Brothers Company, New York, N.Y.

Reexamination Request:
No. 90/001,158, Jan. 30, 1987

Reexamination Certificate for:

| | |
|---|---|
| Patent No.: | **4,539,131** |
| Issued: | **Sep. 3, 1985** |
| Appl. No.: | **501,586** |
| Filed: | **Jun. 6, 1983** |

[30] Foreign Application Priority Data

Jun. 25, 1982 [GB] United Kingdom ..... 8217537
Sep. 24, 1982 [GB] United Kingdom ..... 8227308

[51] Int. Cl.[5] ..... C11D 7/54; C11D 7/14; C11D 7/18; C11D 3/395

[52] U.S. Cl. ..... 252/99; 252/95; 252/140; 252/174.25; 252/186.3; 252/186.31; 252/186.43

[58] Field of Search ..... 252/95, 140, 174.25, 252/186.3, 186.31, 186.43

[56] References Cited

U.S. PATENT DOCUMENTS

| | | | |
|---|---|---|---|
| 4,055,505 | 10/1977 | Gray | 252/102 |
| 4,265,777 | 5/1981 | Boyer et al. | 252/113 |
| 4,269,725 | 5/1981 | Smith et al. | 252/174.25 |
| 4,422,950 | 12/1983 | Kemper et al. | 252/186.38 |
| 4,508,633 | 4/1985 | Strempel et al. | 252/135 |

FOREIGN PATENT DOCUMENTS

| | | |
|---|---|---|
| 0164778 | 12/1985 | . |
| 1520127 | 8/1978 | United Kingdom . |

*Primary Examiner*—Paul R. Michl

[57] ABSTRACT

Improved storage stability of detergent compositions containing an aluminosilicate material as a detergency builder and sodium perborate in the form of its monohydrate having a specific surface area of more than 5 $m^2/g$, preferably more than 7 $m^2/g$. Other conventional materials, in particular other detergency builders, and bleach activators may also be present in the compositions.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-11 are cancelled.

* * * * *